US010294700B2

(12) United States Patent
Scholz et al.

(10) Patent No.: US 10,294,700 B2
(45) Date of Patent: May 21, 2019

(54) VEHICLE DOOR LOCK

(71) Applicant: Kiekert Aktiengesellschaft, Heiligenhaus (DE)

(72) Inventors: Michael Scholz, Essen (DE); Holger Schiffer, Meerbusch (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 120 days.

(21) Appl. No.: 14/647,467

(22) PCT Filed: Nov. 23, 2013

(86) PCT No.: PCT/DE2013/000703

§ 371 (c)(1),
(2) Date: Jun. 25, 2015

(87) PCT Pub. No.: WO2014/082618

PCT Pub. Date: Jun. 5, 2014

(65) Prior Publication Data

US 2015/0308165 A1 Oct. 29, 2015

(30) Foreign Application Priority Data

Nov. 28, 2012 (DE) ..... 10 2012 023 236

(51) Int. Cl.
*E05B 85/24* (2014.01)
*E05B 85/26* (2014.01)
(Continued)

(52) U.S. Cl.
CPC ..... *E05B 85/243* (2013.01); *E05B 77/36* (2013.01); *E05B 79/10* (2013.01); *E05B 81/14* (2013.01);
(Continued)

(58) Field of Classification Search
CPC ..... E05B 85/243; E05B 77/36; E05B 79/10; E05B 81/14; E05B 85/26; E05B 81/06;
(Continued)

(56) References Cited

U.S. PATENT DOCUMENTS 5,020,838 A * 6/1991 Fukumoto ..... E05B 81/14 292/201
5,938,253 A * 8/1999 Szablewski ..... E05B 81/14 292/201
(Continued)

FOREIGN PATENT DOCUMENTS

DE 2326808 A1 5/1973
DE 4318544 C1 5/1994
(Continued)

OTHER PUBLICATIONS

Machine Translation by Google Patent of DE102007050032A1 on Jun. 20, 2015.
(Continued)

*Primary Examiner* — Kristina R Fulton
*Assistant Examiner* — Faria F Ahmad
(74) *Attorney, Agent, or Firm* — Woodard, Emhardt, Henry, Reeves & Wagner, LLP

(57) ABSTRACT

The present invention relates to a vehicle door lock and an associated method for the operation thereof, wherein the vehicle door lock is equipped with a locking mechanism, which essentially consists of a catch and a pawl. The pawl has a contact surface for the catch, which rests on said contact surface when the locking mechanism is closed. According to the invention, a supporting element, which delays the opening of the locking mechanism, is associated with the pawl, so that the catch glides along the contact surface up to a predetermined opening angle until is it is released from the pawl.

19 Claims, 3 Drawing Sheets

(51) Int. Cl.

| | |
|---|---|
| ***E05B 77/36*** | (2014.01) |
| ***E05B 81/14*** | (2014.01) |
| ***E05B 79/10*** | (2014.01) |
| *E05B 81/06* | (2014.01) |
| *E05B 81/42* | (2014.01) |
| *E05B 81/90* | (2014.01) |

(52) U.S. Cl.
CPC ..... *E05B 85/26* (2013.01); *E05B 81/06* (2013.01); *E05B 81/42* (2013.01); *E05B 81/90* (2013.01); *Y10T 292/108* (2015.04); *Y10T 292/1047* (2015.04); *Y10T 292/1082* (2015.04); *Y10T 292/1092* (2015.04)

(58) Field of Classification Search
CPC ..... E05B 81/42; E05B 81/90; Y10T 292/199; Y10T 292/108; Y10T 292/1082; Y10T 292/1092; Y10T 292/104
USPC ..... 292/199, 200, 201, 210, 216, DIG. 23
See application file for complete search history.

(56) References Cited

U.S. PATENT DOCUMENTS

| | | | | |
|---|---|---|---|---|
| 6,059,327 | A * | 5/2000 | Yoshikuwa | E05B 83/16 292/216 |
| 6,076,868 | A * | 6/2000 | Roger, Jr. | E05B 81/14 292/199 |
| 6,386,599 | B1 * | 5/2002 | Chevalier | E05B 81/14 292/201 |
| 6,428,058 | B1 * | 8/2002 | Graute | E05B 85/01 292/201 |
| 6,435,573 | B1 * | 8/2002 | Szablewski | E05B 81/14 292/201 |
| 6,437,532 | B2 * | 8/2002 | Koerwer | E05B 81/14 292/201 |
| 6,439,623 | B1 * | 8/2002 | Lohfeld | E05B 81/20 292/201 |
| 6,459,223 | B2 * | 10/2002 | Mauel | E05B 81/14 292/201 |
| 6,471,259 | B1 * | 10/2002 | Weyerstall | E05B 81/14 292/201 |
| 6,773,042 | B2 * | 8/2004 | Spurr | E05B 77/02 292/201 |
| 6,817,636 | B1 * | 11/2004 | Evans | E05B 81/14 292/201 |
| 7,059,640 | B2 * | 6/2006 | Tensing | E05B 81/14 292/201 |
| 7,111,878 | B2 * | 9/2006 | Kachouh | E05B 81/14 292/201 |
| 7,234,736 | B2 * | 6/2007 | Kachouh | E05B 81/14 292/201 |
| 7,384,080 | B2 * | 6/2008 | Kachouh | E05B 81/14 292/201 |
| 7,568,740 | B2 * | 8/2009 | Brose | E05B 81/06 292/201 |
| 7,946,634 | B2 * | 5/2011 | Bendel | E05B 81/14 292/201 |
| 8,632,106 | B2 * | 1/2014 | Nass | E05B 81/14 292/201 |
| 8,757,680 | B2 * | 6/2014 | Byun | E05B 81/00 292/201 |
| 9,243,429 | B2 * | 1/2016 | Bendel | E05B 77/06 |
| 9,611,676 | B2 * | 4/2017 | Bendel | E05B 77/06 |
| 9,617,761 | B2 * | 4/2017 | Scholz | E05B 81/14 |
| 9,777,517 | B2 * | 10/2017 | Scholz | E05B 85/26 |
| 10,132,109 | B2 * | 11/2018 | Bendel | E05B 85/26 |
| 2001/0010427 | A1 * | 8/2001 | Roos | E05B 81/14 292/201 |
| 2001/0028232 | A1 * | 10/2001 | Koerwer | E05B 81/14 318/445 |
| 2001/0030426 | A1 * | 10/2001 | Kachouh | E05B 81/14 292/169 |
| 2001/0048227 | A1 * | 12/2001 | Kachouh | E05B 81/14 292/216 |
| 2002/0096889 | A1 * | 7/2002 | Nelsen | E05B 81/14 292/201 |
| 2003/0038484 | A1 * | 2/2003 | Schwaiger | E05B 81/14 292/201 |
| 2003/0116977 | A1 * | 6/2003 | Erices | E05B 81/06 292/201 |
| 2004/0056489 | A1 * | 3/2004 | Boecker | E05B 81/14 292/201 |
| 2004/0094971 | A1 * | 5/2004 | Warmke | E05B 81/06 292/201 |
| 2004/0174021 | A1 * | 9/2004 | Tensing | E05B 81/14 292/216 |
| 2005/0200137 | A1 * | 9/2005 | Nelsen | E05B 81/06 292/201 |
| 2009/0295174 | A1 * | 12/2009 | Corrales | E05B 81/14 292/169.14 |
| 2010/0253095 | A1 * | 10/2010 | Bendel | E05B 81/14 292/200 |
| 2011/0169280 | A1 * | 7/2011 | Scholz | E05B 85/26 292/200 |
| 2011/0187132 | A1 * | 8/2011 | Scholz | E05B 81/20 292/226 |
| 2011/0204660 | A1 * | 8/2011 | Cumbo | E05B 85/243 292/217 |
| 2012/0175896 | A1 * | 7/2012 | Martinez | E05B 81/06 292/199 |
| 2012/0313384 | A1 * | 12/2012 | Cumbo | E05B 81/14 292/199 |
| 2014/0049056 | A1 * | 2/2014 | Scholz | E05B 81/14 292/200 |
| 2015/0233157 | A1 * | 8/2015 | Bendel | E05B 85/243 292/199 |
| 2015/0345190 | A1 * | 12/2015 | Dow | E05B 81/06 292/200 |
| 2018/0171678 | A1 * | 6/2018 | Pettengill | E05B 81/15 |
| 2018/0171680 | A1 * | 6/2018 | Hunt | E05B 81/20 |

FOREIGN PATENT DOCUMENTS

| | | | |
|---|---|---|---|
| DE | 102007050032 | A1 | 4/2009 |
| DE | 102009029031 | A1 | 3/2011 |
| DE | 102009029041 | A1 | 3/2011 |
| DE | 102011012999 | A1 | 9/2012 |
| EP | 2492423 | A2 | 8/2012 |

OTHER PUBLICATIONS

Machine Translation by Google Patent of DE102009029041A1 on Jun. 20, 2015.
Machine Translation by Google Patent of DE4318544C1 on Jun. 20, 2015.
Machine Translation by Google Patent of EP2492423A2 on Jun. 20, 2015.
Machine Translation by Lexis Nexis Total Patent of DE102009029031A1 on Jun. 20, 2015.
Machine Translation by Lexis Nexis Total Patent of DE102011012999A1 on Jun. 20, 2015.
Machine Translation by Lexis Nexis Total Patent of DE2326808A1 on Jun. 20, 2015.

* cited by examiner

VEHICLE DOOR LOCK

CROSS-REFERENCE TO RELATED APPLICATIONS

This application is the U.S. national stage application of International Patent Application No. PCT/DE2013/000703, filed Nov. 23, 2013, which claims priority of German Application No. 10 2012 023 236.5, filed Nov. 28, 2012, which are both hereby incorporated by reference.

BACKGROUND

The invention relates to a motor vehicle door lock with a locking mechanism, essentially comprising a catch and pawl, with the pawl containing a contact surface against which the catch rests when the locking mechanism is closed.

In a motor vehicle door lock of the above design, as disclosed in DE 10 2009 029 031 A1, the pawl has a closing moment in the main latching position of the locking mechanism, changing to an opening moment during closing of the locking mechanism. This aims to provide a relatively quiet opening of the known motor vehicle door lock. Such a motor vehicle door lock presents the fundamental problem that the catch and/or the pawl are released more or less abruptly and move apart. At the same time, the pawl or the catch often move against the associated stops.

Such abrupt opening movements are caused by or are a result of relatively great forces acting on the locking mechanism of the motor vehicle door lock or the locking bolt retained in the closed state of the locking mechanism. In most cases these are caused by one or several rubber door seals with the aid of which a respective motor vehicle door is sealed from a car body. When closing the motor vehicle door, the respective rubber door seal is compressed and produces respective resetting forces or a counter pressure which is or are then released when the locking mechanism is opened.

At this point forces or torques often exceeding 500 N m appear at the locking mechanism, resulting in a "plopping noise" typically associated with the opening operation. Most operators find these noises annoying, in particular, as the respective motor vehicle door often amplifies noises at this point as it causes an amplifying resonance or as the noises are transferred as structure-borne noises to the motor vehicle body. This applies in particular for tailgates.

The state of the art disclosed in the aforementioned DE 10 2009 029 031 A1 uses at this point preferably a flat surface in the contact area between the pawl and a contour of the catch, which together with a contact area of the pawl serving to latch the catch, forms an angle of between 120° to 150°. This has generally proven to be successful. The components of the locking mechanism, i.e. essentially the catch and the pawl are, however, punched steel parts that are (can) only be manufactured with a certain accuracy. The same also applies to a normally solid lock case, also made of steel, containing the rotary axes for the locking mechanism parts mounted therein. In other words, the geometric conditions described in DE 10 2009 029 031 A1 can not always be implemented without problems in practical application. This also applies to the further prior art disclosed in DE 23 26 808 A. The invention aims to remedy this.

SUMMARY

The invention is based on the technical problem of further developing a motor vehicle door with the aforementioned design in such a way that noise is reduced whilst providing a simple and functional design.

In order to solve this technical problem, the invention discloses a generic motor vehicle door lock in which a supporting element delaying the opening of the locking mechanism is associated with the pawl, so that the catch glides along the contact surface up to a specified opening angle until it is released from the pawl. This means that as part of the invention, the catch and pawl carry out a delayed relative movement with the contact surface after opening of the locking mechanism. For this purpose, the catch glides along the contact surface on the pawl. Only after completion of its travel and reaching the specified opening angle, is the pawl released from the catch or vice versa.

Generally, the arrangement is such that the predefined opening angle of the catch corresponds to essentially no forces been exerted on the locking mechanism. Upon reaching the specified opening angle of the catch, most of the resetting forces of a rubber door seal disappear. This means that, according to the invention, the catch glides along the contact surface until, in case of the example, the rubber door seal generates no or only negligible resetting forces. This is essentially ensured by the supporting element delaying the opening of the locking mechanism. This controls the movement of the catch along the contact surface of the pawl and thus also the delayed opening of the locking mechanism. The specified opening angle of the catch can also be associated with an opening movement of perhaps 5° to 20° of the catch depending on the design.

As the catch glides along the contact surface and as basically along the entire area of its opening movement resetting forces are produced, the catch of the invention is perfectly guided along the contact surface on the pawl and the catch only leaves the pawl when practically no more resetting forces are applied to the locking mechanism. As a result, the invention prevents a sudden break of the contact bond between the catch and the pawl, thus suppressing any "plopping noise". The catch is after all only released from the pawl or its provided contact surface if resetting forces do not (do no longer) act on the locking mechanism. In this way, the catch carries out a smooth or gliding guided opening movement along the contact surface of the pawl.

As, in this context, the invention uses an additional supporting element as a further structural component, the precise design of the catch and of the pawl and their specific arrangement to each other does not (no longer) matter as much as in the prior art disclosed in DE 10 2009 029 031 A1. This means that the construction effort is considerably reduced compared to prior art embodiments. Furthermore, any manufacturing tolerances of the catch, pawl and lock case do no longer present any problem and can be managed. According to the invention, the catch also only lifts off or is lifted off the pawl when practically no (resetting) forces act on the locking mechanism. This design can be easily implemented by the use of the supporting element.

The supporting element is thus advantageously a contour or delaying contour interacting with an extension arm of the pawl. In most cases the contour or delaying contour is designed as a worm contour.

The contact surface is typically a curved contour. A circular contour has proven to be particularly advantageous. Advantageously, such a circular contour contains a radius essentially corresponding to the distance of the contour from a rotary axis of the pawl.

The pawl is actually—as already explained—rotatably mounted in a lock case. The same applies for the catch. The radius of the contour or contact surface of the pawl essentially corresponds to the distance from the axis of rotation. The pawl can thus carry out an opening movement around its axis of rotation. This opening movement corresponds to the contour and, in particular, the circular contour provides a circular arc along which the catch glides. In the opening direction of the pawl this circular arc contains an increasing radius.

In most cases, one edge of the catch does actually rest against the respective contour and glides along the circular contour with this edge and regularly in an opposite direction of movement in relation to the pawl. The movement of the catch is as such initiated by an associated spring, pretensioning the catch in order to open it and, in particular, the resetting forces of the rubber door seal.

The supporting element or the (delaying) contour provided at this point is generally arranged on a worm gear. The worm gear can also contain a locking lever and/or act on such a locking lever. In most cases the design is such that the locking lever and the supporting element interact immediately with the pawl. In the invention this means that in most cases the locking lever initially releases the pawl. The locking mechanism is then opened. The catch then attempts (with the aid of the spring or due to the resetting forces) to move into its opening position. During this process, the edge of the catch glides along the contact surface or circular contour making way during this process.

In order for the pawl not to be immediately pivoted away from the catch in this context, the delaying contour or worm contour on the worm gear ensures that the extension arm of the pawl interacting therewith glides along the delaying contour and that, as a result, the pawl carries out the described movement. At the same time, the edge of the catch can glide along the contact surface and until it leaves the pawl. This is generally only the case when forces do not (no longer) act on the locking mechanism.

The worm gear and the locking lever advantageously arranged thereon as well as the delaying contour are typically acted upon by a drive for electric opening. In this case, the drive ensures that the already described direct sequence is observed by the locking lever and then by the supporting element, interacting in succession with the pawl. The drive is also able to control the delayed opening of the locking mechanism with the speed of the worm gear.

The object of the invention is also a procedure for the operation of such a motor vehicle door lock, as explained in more detail in claim 10.

Below, the invention is explained with reference to a drawing showing only one embodiment; the individual figures show the following

DETAILED DESCRIPTION OF THE DRAWINGS

Figure 1:
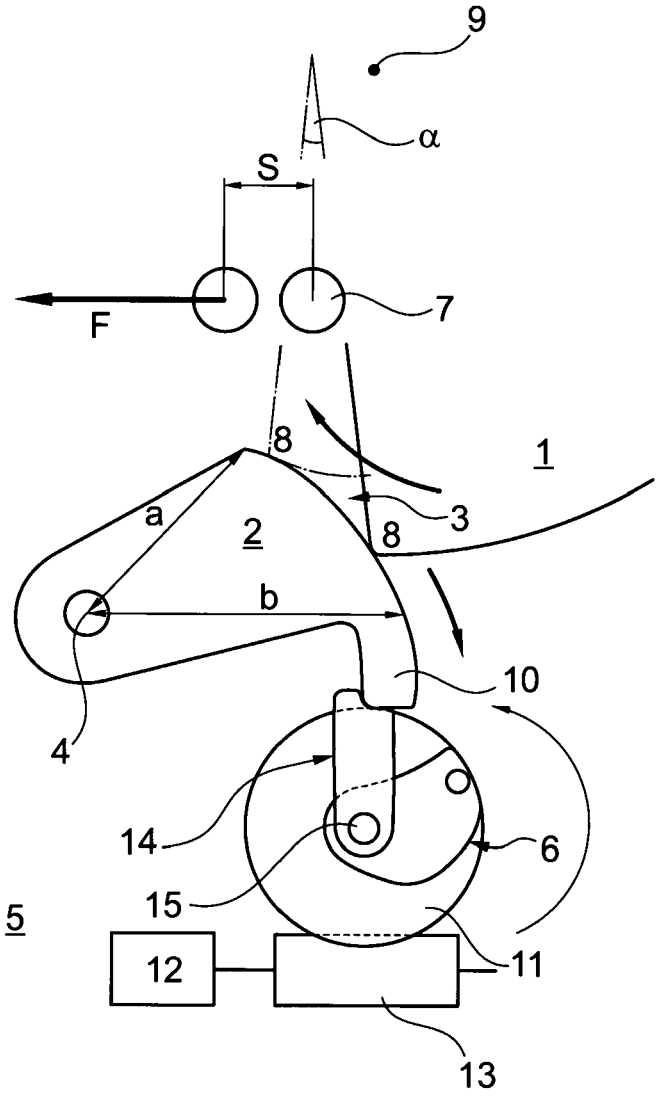
FIG. 1 shows the motor vehicle door lock of the invention reduced to the essential components in a first embodiment and FIG. 2 shows a further embodiment of the motor vehicle door lock of the invention and FIGS. 3A-3D show the motor vehicle door lock of FIG. 2 in different functional positions.

The figures show a motor vehicle door lock which can be designed as a motor vehicle side door lock. Generally, the lock is, however, a motor vehicle tailgate lock. In all cases the respective motor vehicle door lock contains a locking mechanism 1, 2 essentially comprising a catch 1 and a pawl 2. The pawl 2 contains a contact surface 3 for the catch 1, resting against said pawl in the closed state of the locking mechanism 1, 2. In the embodiment, the contact surface 3 is an arched contour and, in particular, a circular contour 3. The pawl 2 is mounted around a rotation axis 4. The rotation axis 4 is defined by a pin or bearing pin on which the pawl 2 is rotatably mounted in relation to a respective lock case 5, as shown in FIG. 2.

The contact surface of circular contour 3 contains, as shown in FIG. 1 and in opening direction of the pawl 2, which means in this instance in case of a rotation of the pawl 2 around its rotation axis 4 in clockwise direction (see arrow in FIG. 1), an increasing radius, increasing from a length a up to a greater length b. In the embodiment shown in FIG. 1 the relation $$b \approx 1.3a$$

applies.

Figure 2:
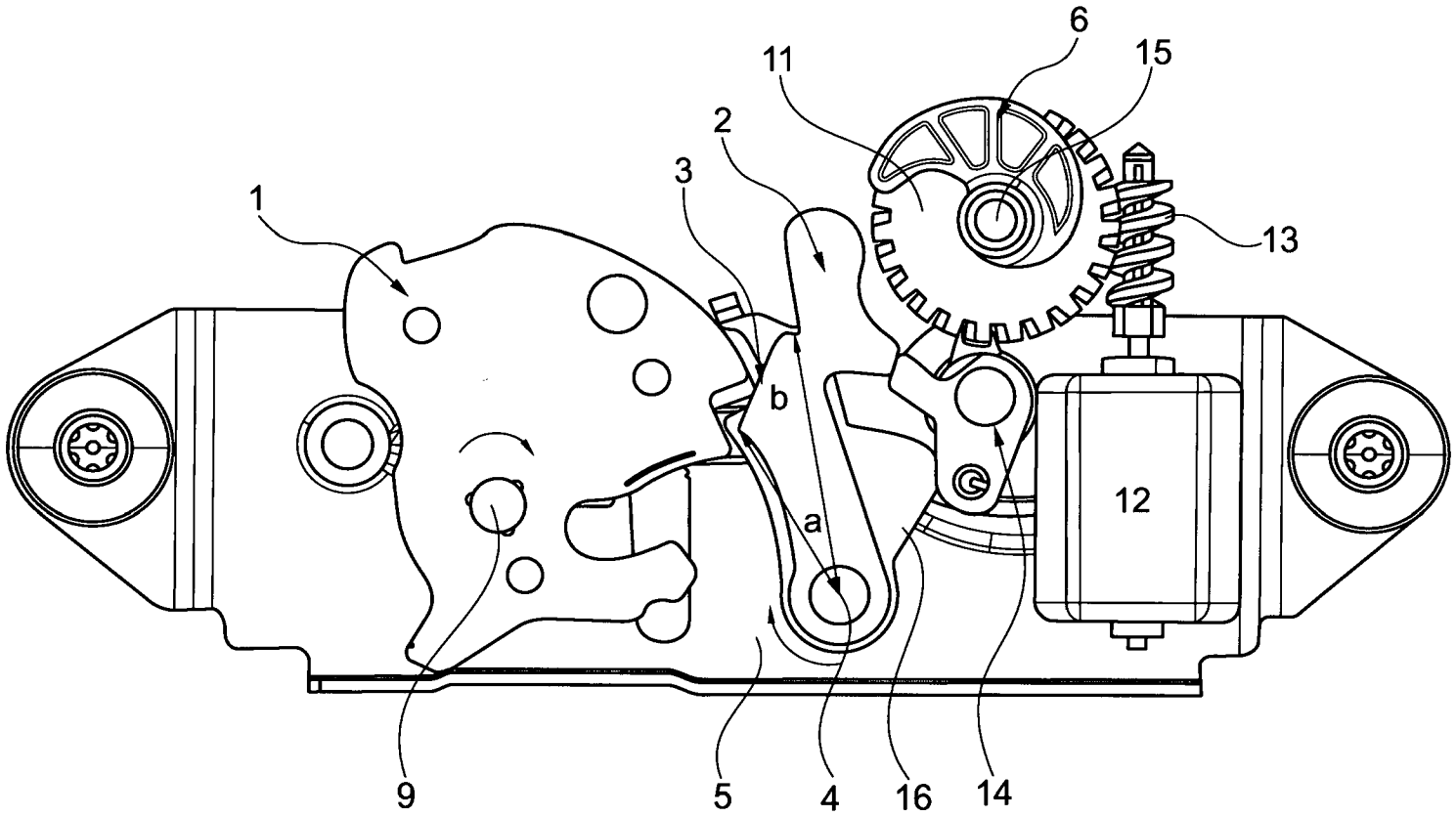

In the embodiment shown in FIGS. 2 and 3, the contact surface 3 of the pawl 2 also contains an increasing radius in the opening direction of the pawl 2 (rotary movement of the pawl 2 around its axis 4 in clockwise direction). In the opening direction of the pawl 2 the size of the radius is initially around a and then increases to b. The ratio is similar to the one described above.

Of particular significance is that the invention provides for an additional supporting element 6 assigned to the pawl 2. This supporting element 6 assigned to the pawl 2 provides a delayed opening of the locking mechanism. This means that the supporting element 6 prevents that the pawl 2 is suddenly lifted off the catch 1 during opening of the locking mechanism 1, 2 so that, as a result, the catch 1 opens by means of a spring or by resetting forces applied by the rubber door seal and releases a previously retained locking bolt 7.

The delayed opening of the locking mechanism by means of the supporting element 6 ensures that the catch 1 glides along the contact surface 3 up to a specified opening angle. This opening angle corresponds to an opening angle $\alpha$ across which the catch 1 moves during this process and which is indicated by a dash/doted line in FIG. 1. In the embodiment shown in FIG. 1, one edge 8 of the catch 1 glides along the contact surface 3. At the same time, the pawl 2 moves in the opposite direction, i.e. carries out a clockwise movement in the opening sense around a respective rotation axis 4. The catch 1 also moves in clockwise direction. As a result, the catch 1 passes over the angle $\alpha$ during the described delayed opening of the locking mechanism, as indicated in FIG. 1. The opening angle $\alpha$ can have a value of between 5° and 20°. The opening angle $\alpha$ of the catch 1, across which the catch 1 moves as part of the delayed opening of the locking mechanism 1, 2, corresponds to a predefined opening angle of the catch 1 and consequently also of an associated motor vehicle door—not shown. At the same time, the locking bolt 7 moves along an opening path s during this process, as indicated in FIG. 1. This opening path s corresponds to the opening angle $\alpha$ or the specified opening angle of the catch 1 as part of the delayed opening of the locking mechanism 1, 2.

After completion of the opening path s or the aforementioned specified opening angle of the catch 1, the locking mechanism 1, 2 is essentially not exposed to any force. This means that when the catch 1 has reached its opening angle or after the opening angle s of the locking bolt 7 has been reached, the resetting forces F indicated in FIG. 1 and exerted by the rubber door seal of the motor vehicle door are not (no longer) applied. In FIG. 1 the respective resetting forces F are indicated by a force error and are applied in this case in such a way that they act on the locking bolt 7 in a force direction to the left side. At the same time, the resetting forces F act on the catch 1 in such a way that it is acted upon around its axis 9 in clockwise direction or that the torques desribed in the introduction to the description are exerted.

Generally these resetting forces F ensure that during opening of the locking mechanism 1, 2 the pawl 2 is pivoted directly away from the catch 1 and that the catch 1 carries out the indicated opening movement. This corresponds essentially to a rotary movement of the catch 1 around its axis in clockwise direction. According to the invention, the catch 1 carries out a pivoting movement around angle $\alpha$, as described. As part of this pivoting movement of the catch 1, the respective edge 8 glides along the contact surface 3 of the pawl 2. This process is also facilitated by the fact that the pawl 2 contains an increasing radius a, b at the contact surface or circular contour 3 during its opening process, so that the catch 1 is being increasingly opened, essentially caused by the resetting forces F and/or the opening spring allocated to the catch 1. Due to its counter movement in relation to the pawl 2, the edge 8 of the catch 1 moves against a decreasing radius b, a on the contact surface 3, resulting in a controlled opening of the catch 1.

In order to achieve the described delayed opening of the locking mechanism 1, 2 in this context, the supporting element 6 is a contour or delaying contour 6 interacting with an extension arm 10 of the pawl 2. In the embodiment, the supporting element or the delaying contour 6 is arranged on a worm gear 11. In the embodiment, the worm gear 11 is acted upon by a drive 12, 13, by means of which the locking mechanism 1, 2 can be electrically opened as explained in detail below.

In addition to the supporting element or the delaying contour 6, the worm gear 11 also contains a locking lever 14 in FIG. 1. Generally the design can be such that the worm gear 11 acts upon the respective locking lever 14. In this case, the locking lever 14 is not mounted on or at the worm gear 11 but separately in lock case 5. This is shown in FIGS. 2 and 3.

The overall arrangement is such that the locking lever 14 and the support element 6 interact with the pawl 2 in close succession. In the example shown in FIG. 1 the drive 12, 13 ensures that the worm gear 11 first carries out a small movement around its respective axis 15 in counterclockwise direction for opening the locking mechanism 1, 2, as shown by an arrow. This releases the previously blocked pawl 2 from the locking lever 14.

As a result, the edge 8 of the catch 1 can role down the contact surface or circular contour 3 whilst the pawl 2 is pivoted in clockwise direction around its rotation axis 4 during this process. This process is, however, controlled or delayed as after the release of the locking lever 14 from the pawl 2, the supporting element or the delaying contour 6 engages with the extension arm 10 on the pawl 2. The delayed opening of the locking mechanism 1, 2 actually corresponds to the extension arm 10 rolling down the supporting element or delaying contour 6, so that the pawl 2 as a whole moves at a speed specified by the drive 12, 13 around its rotation axis 4 in clockwise direction.

Similarly, the catch 1 also carries out an opening movement controlled by the drive 12, 13 and until the locking bolt 7 has completed the opening travel s. The extension arm 10 is then released from the supporting element or the delaying contour 6 and can pivot the pawl 2 completely away from the catch 1 which is then opened by means of the spring and fully releases the locking bolt 7.

Figure 3A:
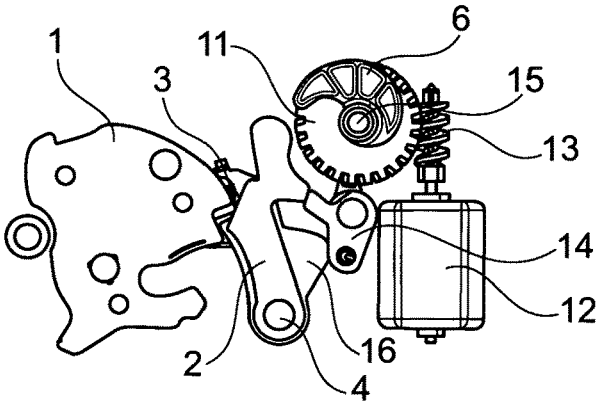
Figure 3B:
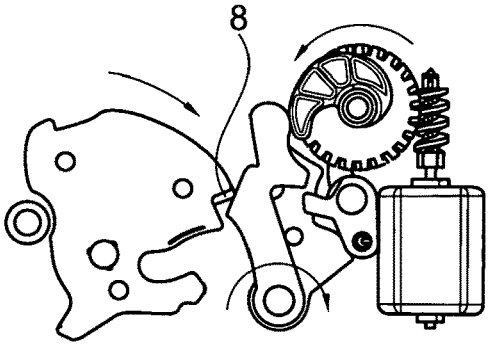

These steps are also clear from FIGS. 2 and 3A to 3B. FIG. 2 or 3A initially show the locking mechanism 1, 2 in its closed state. In order to open the locking mechanism the provided drive 12, 13 is energized, said drive consisting of an electric motor 12 and a driving worm 13 acted upon by the electric motor 12 for the worm gear 11. After this electric opening of the locking mechanism 1, 2 the worm gear 11 is pivoted around its axis 15 in counter-clockwise direction during the transition from FIG. 3A to FIG. 3B. This process also causes the locking lever 14 to be released from the pawl 2 by means of the drive 12, 13 so that the pawl 2 can essentially open around its rotation axis 4 in clockwise direction. This opening movement is, however, delayed in a controlled manner by the supporting element or the delaying contour 6.

Figure 3C:
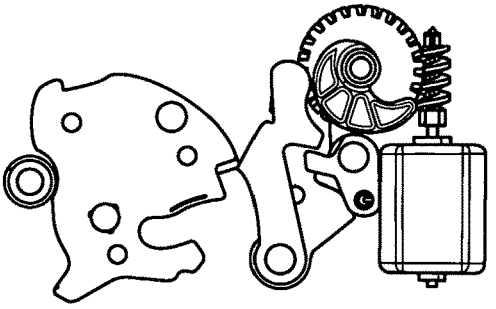
Figure 3D:
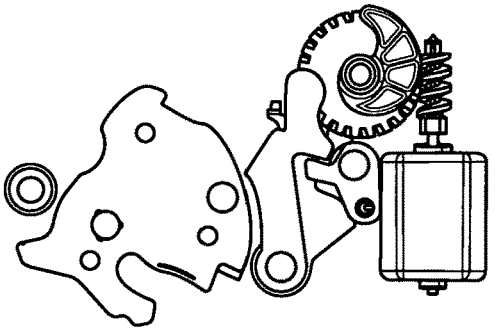

During the continued travel of the worm gear 11 in clockwise direction around its associated axis 15 and during the transition from FIG. 3B to FIG. 3C, the pawl 2 is controlled by the delaying contour 6 or by the drive 12, 13, in order to act on the rotation axis 4 for opening. As a result, the edge 8 of the catch 1 can also glide along the contact surface 3 in a controlled manner and until the locking bolt 7 has completed the opening travel. This occurs during the transition from FIG. 3C to FIG. 3D. The edge 8 of the catch 1 is then able to leave the contact surface 3 on the pawl 2 and the catch 1 is then fully released from the pawl 2. The catch 1 then opens and fully releases the locking bolt 7.

FIGS. 2 and 3 also show a initial latching pawl 16, retaining the catch 1 in a closed condition together with the pawl 2 in connection with the locking lever 14 and which is pivoted away from the catch 1 for opening of the locking mechanism 1, 2 by means of the drive 12, 13. The latching pawl 16 is thus of no further significance for the described functionality so that it does not have to be described in further detail.

In addition to the described electric opening of the locking mechanism 1, 2 by means of the drive 12, 13 also a mechanical opening in the sense of an emergency release is possible. For this purpose the locking lever 14 is, for instance, starting from the functional position shown in FIG. 3A, lifted off the pawl 2 by mechanical means and not with the aid of the drive 12, 13 and then reaches the position shown in FIG. 3B. As a result, the pawl 2 can pivot in relation to the (stationary) worm gear 11 and without the pawl 2 interacting with the supporting element or the delaying contour 6. This can be directly achieved from the functional position shown in FIG. 3A as the pawl 2 is pivoted essentially "below" the supporting element 6 or the delaying contour 6 around its rotation axis 4. As a result the catch 1 is directly released and the locking mechanism 1, 2 opens without the described delayed opening process 5 of the locking mechanism 1, 2.

In the shown embodiment, it is however primarily the electric drive 12, 13 in connection with the worm gear 11 and the supporting element or the delaying contour 6, that ensures that the pawl 2 can directly interact with the supporting element or the delaying contour 6 once the pawl or the latching pawl 16 is released from its engagement in the catch 1. As a result, the pawl 2 carries out an opening movement controlled by the drive 12, 13. The controlled opening movement of the pawl 2 corresponds to the edge 8 of the catch 1 rolling off the contact surface 3 of the opening pawl 2, also controlled by the drive 12, 13. This releases the catch 1 from the pawl 2 and generally only once no or only minor resetting forces F act on the locking mechanism 1, 2.

As a result, the locking mechanism 1, 2 is gently opened and the "opening plop" known from prior art is avoided.

The invention claimed is:

1. A motor vehicle door lock, having a locking mechanism, the motor vehicle door locking comprising:

a catch, a pawl and a locking lever that abuts the pawl to lock the pawl against the catch when the locking mechanism is closed, in which the pawl has a contact surface for the catch which rests on said contact surface when the locking mechanism is closed, wherein the pawl contacts a supporting element that delays the opening of the locking mechanism after release of the locking lever, so that the catch glides along the contact surface up to a specified opening angle, until it is released from the pawl, wherein the supporting element is arranged on a worm gear that acts on the locking lever, wherein the supporting element defines a curved delaying contour that contacts the pawl, wherein the locking lever and the supporting element interact with the pawl in direct succession, and wherein after the release of the locking lever from the pawl, the supporting element or a delaying contour on the support element engages with an extension arm on the pawl.

2. The motor vehicle door lock according to claim 1, wherein the specified opening angle of the catch corresponds to minimal or no force being exerted on the locking mechanism.

3. The motor vehicle door lock according to claim 1, wherein the curved delaying contour is a circular contour.

4. The motor vehicle door lock according to claim 3, wherein the circular contour contains an increasing radius.

5. The motor vehicle door lock according to claim 1, wherein the worm gear is being acted on by a drive for electric operation, which also preferably controls the delayed opening of the locking mechanism.

6. A method for the operation of a motor vehicle door lock, with a locking mechanism comprising a catch and pawl, according to which the catch rests against a contact surface of the pawl in the closed state of the locking mechanism and according to which a supporting element is provided, wherein the supporting element is arranged on a worm gear that acts on a locking lever and wherein the locking lever and the supporting element interact with the pawl in direct succession rotating the worm gear thereby unlocking the locking lever causing the pawl to abut the support element thereby delaying an opening of the locking mechanism such that continued rotation of the worm gear causes the catch to glide along the contact surface up to a specified opening angle releasing the catch from the pawl.

7. The motor vehicle door lock according to claim 1, wherein the worm gear is being acted on by a drive for electric operation, which also preferably controls the delayed opening of the locking mechanism.

8. The motor vehicle door lock according to claim 1, wherein the specified opening angle of the catch corresponds to minimizing resetting forces of a rubber door seal of a door that the motor vehicle door lock is installed in.

9. The motor vehicle door lock according to claim 1, wherein the contact surface is an arched contour.

10. The motor vehicle door lock according to claim 1, wherein, in an initial position with the locking mechanism closed, the pawl does not contact the support element.

11. The motor vehicle door lock according to claim 10, wherein, moving the support element into contact with the pawl moves the pawl toward the catch thereby releasing the locking lever.

12. The motor vehicle door lock according to claim 11, wherein further moving the support element after initial contact with the pawl allows the pawl to gradually move away from the catch until the catch is released.

13. A motor vehicle door lock having a locking mechanism, the motor vehicle door lock comprising:

a catch having a closed position and an open position and rotatable in an opening direction from the closed position to the open position;

a pawl having a blocking position where the pawl abuts that catch to hold the catch in the closed position and an unblocking position where the pawl does not restrict movement of the catch;

an extension arm on the pawl;

a locking lever having a locking position where the locking lever abuts the pawl to hold the pawl in the blocking position and an unlocked position where the locking lever does not restrict movement of the pawl;

a support element having a delaying contour that is selectively movable against the extension arm, wherein initial contact of the delaying contour against the extension arm shifts the pawl allowing the locking lever to move from the locking position to the unlocked position and further movement of the delaying contour gradually moves the pawl from the blocking position to the unblocking position at a specified opening angle of the catch.

14. The motor vehicle door lock according to claim 13, further comprising a worm gear that rotates the support element.

15. The motor vehicle door lock according to claim 13, wherein the delaying contour is a circular contour.

16. The motor vehicle door lock according to claim 15, wherein the circular contour contains a varying radius that corresponds to a distance to an axis of rotation of the pawl.

17. The motor vehicle door lock according to claim 13, wherein, in an initial position with the locking mechanism closed, the support element does not contact the pawl.

18. The motor vehicle door lock according to claim 17, wherein, moving the support element into contact with the pawl moves the pawl toward the catch thereby releasing the locking lever.

19. The motor vehicle door lock according to claim 18, wherein further moving the pawl toward the catch moves the pawl away from its unblocking position.

* * * * *